United States Patent [19]

Tanaka et al.

[11] 3,947,019

[45] Mar. 30, 1976

[54] COPY PAPER SHEET SEPARATING DEVICE

[75] Inventors: Susumu Tanaka, Sakai; Yuji Enoguchi, Osaka; Hidetoshi Kawabata, Tondabayashi, all of Japan

[73] Assignee: Minolta Camera Kabushiki Kaisha, Osaka, Japan

[22] Filed: June 5, 1974

[21] Appl. No.: 476,619

[30] Foreign Application Priority Data

July 27, 1973 Japan ..... 48-89572[U]

[52] U.S. Cl. ..... 271/174; 271/DIG. 2

[51] Int. Cl.[2] ..... B65H 29/56

[58] Field of Search ..... 271/DIG. 2, 80, 172, 174; 198/230; 355/3 R

[56] References Cited

UNITED STATES PATENTS

| | | | |
|---|---|---|---|
| 2,731,263 | 1/1956 | Baril, Jr. et al. | 271/172 |
| 3,614,095 | 10/1971 | Beck et al. | 271/80 |
| 3,684,363 | 8/1972 | Ito et al. | 355/3 R |
| 3,824,011 | 7/1974 | Suzuki et al. | 355/3 R |
| 3,834,690 | 9/1974 | Knechtel | 271/80 |

*Primary Examiner*—Evon C. Blunk
*Assistant Examiner*—Robert Saifer
*Attorney, Agent, or Firm*—Wenderoth, Lind & Ponack

[57] ABSTRACT

A separating device for copy paper sheets for use in a photocopying apparatus includes a long, thin separating tape of an insulating material which is disposed lengthwise, in the direction of advance of a copy paper sheet, between one side edge of the photoreceptor surface and the corresponding side edge of the copy paper sheet to be separated, and a pick-off thread or string of an insulating material stretched diagonally and slantwise across the plane into which the copied paper sheet is fed. One side of the copied paper sheet is initially separated by the separating tape, and as the sheet is further delivered, it passes under the pick-off thread so as to be wholly peeled off the photoreceptor surface.

13 Claims, 3 Drawing Figures

COPY PAPER SHEET SEPARATING DEVICE

BACKGROUND OF THE INVENTION

The present invention relates to an electrostatic photocopying apparatus, and more particularly to a separating device for copied copy paper sheets for use therein.

Generally, in a photocopying apparatus of the above type, an electrostatic latent image formed on a charged photoreceptor surface is developed at a developing station in the apparatus by developing material comprising carrier material and toner powder to produce a visible toner powder image in the configuration of the latent image on the photoreceptor surface for transfer onto a copy paper sheet to obtain a copy of the image of an original thereon. After completion of transfer, the copy paper sheet with visible toner powder image thereon is separated from the photoreceptor surface to be sent to a subsequent processing device such as a fuser for fixing.

According to the conventional copying apparatus, a non-contact method employing an A.C. charger, an air jet and air suction or contact method using a separating piece and a separating belt, or a combination of both, are adopted for the separation of copy paper sheets from the photoreceptor surface. However, conventional separating devices of the above described types are not only complicated in construction and expensive, but also rather unstable in performing their separating functions, and have such disadvantages as damaging the photoreceptor surface, especially in the devices employing the contact method.

SUMMARY OF THE INVENTION

Accordingly, an essential object of the present invention is to provide a separating device for copy paper sheets which is accurate and reliable in functioning with substantial elimination of the disadvantages inherent in the conventional copy paper sheet separating devices.

Another important object of the present invention is to provide a separating device of the above described type which is very simple in construction and easy of maintenance.

A still further object of the present invention is to provide a separating device of the above described type which can be produced at low costs.

According to a preferred embodiment of the present invention, the separating device for copy paper sheets comprises merely a long, thin tape of an insulating material such as polyester film which is disposed lengthwise between one side edge of a photoreceptor surface and the corresponding side edge of a copy paper sheet to be separated, and a pick-off thread or string of an insulating material streched diagonally and slantwise across the plane into which the copied paper sheet is fed.

The copy paper sheet to be copied is fed onto the photoreceptor surface through a pair of paper guides adjacent to a space between the photoreceptor surface bearing a toner powder image thereon and a charger disposed below the photoreceptor surface. The leading edge of the copied paper sheet easily comes off the photoreceptor surface at the side of the separating tape disposed between the corresponding side edges of the photoreceptor surface and the copied paper sheet as described above and is caught by a pick-off thread as the copied paper sheet advances by the rotation of the photoreceptor, and the whole copied paper sheet is completely peeled off the photoreceptor surface as the sheet passes under the pick-off thread, being slightly pressed downward by the thread. Furthermore, a cleaning device for the pick-off thread is provided for wiping off any developing material adhering to the thread so as to avoid any smearing of the toner powder image transferred on the copy paper sheet.

As is seen from the above, according to the device of the present invention, the copied paper sheets are positively separated from the photoreceptor surface very efficiently without complicated mechanisms associated therewith.

BRIEF DESCRIPTION OF THE DRAWINGS

These and other objects and features of the present invention will become apparent from the following description taken in conjunction with the preferred embodiment thereof with reference to the accompanying drawings, in which.

DETAILED DESCRIPTION OF THE INVENTION

Before the description of the present invention proceeds, it is to be noted that like parts are designated by like numerals throughout the several views of the accompanying drawings.

Figure 1:
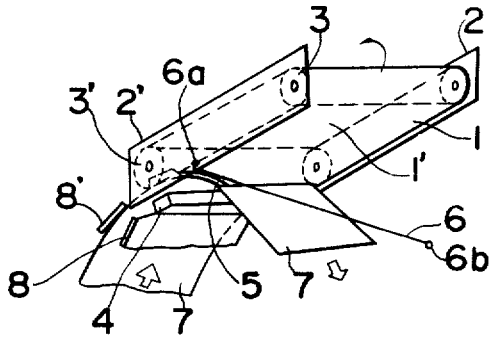
FIG. 1 is a perspective view of a separating device of the invention and mechanisms of a copying apparatus associated therewith.

Referring to FIG. 1, there is shown a known electrostatic photosensitive photoreceptor 1 in the configuration of an endless belt suspended by a pair of rollers 3 and 3' which are rotatably mounted, in parallel to each other in the same plane, between side walls 2 and 2' of the apparatus, with one of the rollers 3 or 3' driven by a conventional means for rotation of the photoreceptor belt 1. A transfer corona charger 4 is disposed under the photoreceptor surface 1' below the backward or lower run of the belt with a slight distance therebetween for transferring a toner powder image formed on the surface 1' onto a copy paper sheet 7.

A long, thin separating tape 5 of rectangular shape about 10mm wide which is made of an insulating material such as polyester film or the like for separating the copy paper sheet from the surface 1' is disposed lengthwise in parallel and adjacent to one of the side walls 2' at a position below the surface 1' with part of one long side edge of the tape 5 suitably secured to the side wall 2' and with part of the surface of the tape 5 contacting the photoreceptor surface 1'.

In this state, it will be seen that the separating tape 5 which is long and thin and disposed as above with the surface thereof facing the corresponding side of the surface 1' tends to curve downward, to a certain extent, at the free end thereof into an arcuate configulation.

A copy paper sheet pick-off thread 6 of an insulating material, for example, of nylon or the like for subsequently peeling off copy paper sheets is suitably secured at one end thereof at a position **6*a* immediately above the surface of the separating tape 5 (to the side wall 2' in the drawing) with the other end thereof suitably secured at a position 6b under the other side of the surface 1'. Since the position 6b is lower than the position 6a in the side wall 2' and is somewhat ahead of the position 6a in the direction of advance of the copy paper sheet 7, the thread 6 is stretched between the positions 6a and 6b diagonally and slantwise across the copy paper sheet 7 as shown in FIG. 1**.

A pair of guide plates 8 and 8' for guiding the copy paper sheets are provided, in spaced relation to each other, adjacent to the space between the surface 1' and the charger 4 at the side of the charger 4 remote from the thread 6, through which guide plates 8 and 8' copy paper sheets are fed onto the surface 1' facing the charger 4.

Accordingly, the copy paper sheet 7 thus fed through the guide plates 8 and 8' in the direction of the large arrows adheres to the photoreceptor surface 1' bearing the toner powder image as the phtoreceptor 1' rotates in the direction shown by a small arrow with the toner powder image transferred onto the copy paper sheet 7.

In this state, however, since the separating tape 5 is disposed between one side of the copy paper sheet 7 approximately 10mm wide and the corresponding portion of the photoreceptor surface 1', the edge of the copy paper sheet 7 begins to be separated from the photoreceptor surface 1' at the above portion below the separating tape 5 along the curvature of the tape 5 as the photoreceptor 1' rotates, and the whole sheet 7 is further peeled off the surface 1' completely, being slightly pressed down by the thread 6 as the sheet 7 passes under the thread 6 stretched slantwise as described above.

Figure 2:
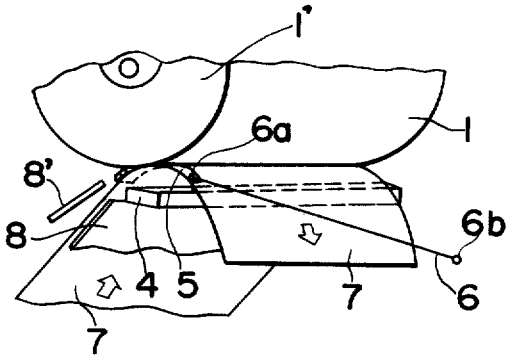
FIG. 2 is a perspective view of a modification of the separating device in FIG. 1 and mechanisms of a copying apparatus associated therewith.

Referring to FIG. 2, there is shown a modification of the embodiment of FIG. 1. In this modification, the separating tape 5 is applied to a copying machine which employs a photoreceptor 1 in the configuration of a drum 1' driven by a conventional means. In this case also, the separating tape 5 is appropriately secured, at one end thereof, to a sidewall or a suitable supporting member of the copying apparatus (not shown) in the same manner as in FIG. 1, with the pick-off thread stretched between two positions 6a and 6b, but one end of the pick-off thread 6 is suitably secured to the other end of the tape 5 as at 6a. Functions of the separating tape 5 and the pick-off thread 6 are exactly the same as in FIG. 1, so that the description thereof is abbreviated for brevity.

Figure 3:
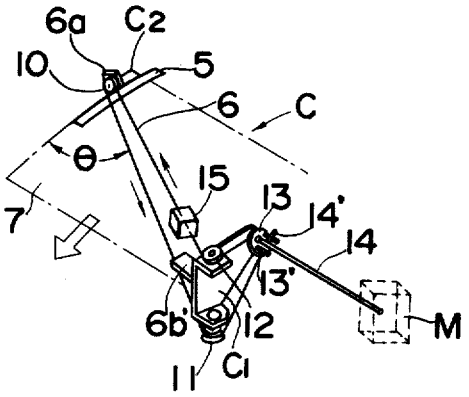
FIG. 3 is a perspective view of a cleaning device for a pick-off thread applicable to the devices in FIGS. 1 and 2.

Referring now to FIG. 3, there is shown a cleaning device C for the pick-off thread 6. The cleaning device C comprises a bracket C1 of an inverted regular triangular shape which is suitably secured to a side wall (not shown) of the apparatus, at a position 6b' close to the position 6b in FIGS. 1 and 2, three small pulleys 13, 12 and 11 each rotatably mounted in the vicinity of each angled corner of the bracket C1, a bracket C2 suitably secured to the apparatus (not shown), on the side thereof opposite to the bracket C1, at a position 6a equivalent to the position 6a in FIGS. 1 and 2 and on which another small pulley 10 is rotatably mounted, a cleaning block 15 of polyurethane foam such as Moltplen or the like suitably secured to the bracket C1 or other suitable places (not shown) close to the bracket C1, and the pick-off thread 6 which is passed, in an endless path, from the driving pulley 13, around the pulley 12, through the cleaning block 15, around the pulleys 10 and 11, and back to the pulley 13. The driving pulley 13 is provided with a pair of short pins 13' extending outwardly at right angles from the surface of the pulley 13, while a driving shaft 14 drivingly connected at one end thereof to a motor M and having a pin 14' at the other end thereof, which extends at right angles to the axis of the shaft 14, is adapted to engage the pins 13' for rotating the pulley 13.

Upon rotation of the pulley 13 by the shaft 14, the thread 6 turns around the endless path in the direction shown by the small arrows in FIG. 3 with any developing material adhering to the thread 6 wiped off as the thread 6 passes through the cleaning block 15.

According to an experiment it has been found that copy paper sheets are most effectively peeled off the photoreceptor surface 1' when the pick-off thread 6 is stretched across the copy paper sheet 7 at angles $\theta$ between 30° and 60° (30° and over to 60° and under) to the advancing direction of the copy paper sheet 7 shown by a large arrow in FIG. 3.

It is needless to say that the above angles $\theta$ and the cleaning device C described above are applicable to the devices shown in FIGS. 1 and 2.

Although, in the device of the invention described above, transfer cannot be made in that narrow portion approximately 10mm wide in which the separating plate 5 is interposed, no inconvenience is experienced in practical use since such a narrow portion at one side of the copy paper sheet serves as a filing margin.

As is clear from the above description, the separating device for the copy paper sheets according to the present invention is applicable for copying machines of the toner powder image transfer type and the electrostatic latent image transfer type, making it possible to separate copied paper sheets readily and positively from the photoreceptor surface after transfer.

Furthermore, since the device is simple in construction, comprising merely the separating tape, and the pick-off thread simply stretched across the surface of the copy paper sheet, it can be manufactured at low cost, and yet the separating tape made of an insulating material never damages the photoreceptor surface during contact therebetween, which fact results in saving of maintenance costs.

The provision of the cleaning device for the pick-off thread is very effective especially when the image transferred onto the copy paper sheet is of toner powder image, in which case it is possible that the pick-off thread is soiled by developing material after many copy paper sheets have been separated, thus smearing the toner powder image transferred on subsequent copy paper sheets.

Although the present invention has been fully described by way of example with reference to the attached drawings, it is to be noted that various changes and modifications are apparent to those skilled in the art. Therefore, unless otherwise such changes and modifications depart from the scope of the present invention, they should be construed as included therein.

What is claimed is:

1. A separating device for copy paper sheets for use in a photocopying apparatus, said device comprising:

an elongate, thin separating tape of an insulating material disposed at a position between one side edge of a photoreceptor surface of a photocopying apparatus and a corresponding side edge of a copy paper sheet relative to a direction of advance of said copy paper sheet;

said tape being secured, at one portion thereof to extend lengthwise and in parallel to said direction of advance of said copy paper sheet, to said photocopying apparatus with a first surface of said tape facing said photoreceptor surface and with part of said first surface of said tape contacting said photoreceptor surface, whereby as said copy paper sheet advances the leading portion of said side edge thereof is separated from said photoreceptor surface by a second surface of said tape;

a pick-off thread forming means for further peeling said copy paper sheet off said photoreceptor surface completely;

said thread being stretched, at a discharging side for said copy paper sheet, between a first position immediately above to a first side of said photoreceptor surface adjacent said second surface of said tape and a second position below a second side of said photoreceptor surface relative to a direction of movement of said photoreceptor surface; and said second position being lower than said first position and being ahead of said first position relative to said direction of advance of said copy paper sheet;

whereby said stretched thread presses a surface of said copy paper sheet downwardly as said copy paper sheet passes under said thread during advancement of said sheet.

2. A separating device for copy paper sheets for use n a photocopying apparatus, said device comprising:

an elongate, thin separating tape of an insulating material disposed at a position between one side edge of a photoreceptor surface of a photocopying apparatus and a corresponding side edge of a copy paper sheet relative to a direction of advance of said copy paper sheet;

said tape being secured, at one portion thereof to extend lengthwise and in parallel to said direction of advance of said copy paper sheet, to said photocopying apparatus with a first surface of said tape facing said photoreceptor surface and with part of said first surface of said tape contacting said photoreceptor surface, whereby as said copy paper sheet advances the leading portion of said side edge thereof is separated from said photoreceptor surface by a second surface of said tape;

a pick-off thread forming means for further peeling said copy paper sheet off said photoreceptor surface completely;

said thread being stretched, at a discharging side for said copy paper sheet, between a first position adjacent to a first side of said photoreceptor surface adjacent said second surface of said tape and a second position below a second side of said photoreceptor surface relative to a direction of movement of said photoreceptor surface;

said second position being lower than said first position and being ahead of said first position relative to said direction of advance of said copy paper sheet;

whereby said stretched thread presses a surface of said copy paper sheet downwardly as said copy paper sheet passes under said thread during advancement of said sheet;

a thread cleaning device comprising a plurality of guide pulleys and a cleaning block, said thread being extended from said first and second positions to pass around said guide pulleys and through said cleaning block along an endless path so that said thread is cleaned by said cleaning block as it moves along said endless path.

3. A separating device for copy paper sheets as claimed in claim 2, wherein said first position is located immediately above said second surface of said tape.

4. A separating device for copy paper sheets as claimed in claim 2, wherein said first position is located on a first end of said tape.

5. A separating device, for use in an electrostatic photocopying apparatus of the type including a movable photoreceptor and an image transferring means, for separating copying paper from said photoreceptor, said device comprising:

an insulating tape member disposed between an image transferring means and a photoreceptor of an electrostatic photocopying apparatus;

said tape member facing one edge of a surface of said photoreceptor in a direction of advance of the copying paper;

said tape member being provided in a position allowing the transfer of an image from said photoreceptor surface to said copying paper, and said tape having surface means for guiding the leading portion of one side edge of said copying paper away from said photoreceptor surface for initial separation thereof from said photoreceptor; and a thread member secured at one end thereof to said insulating tape member and stretchably disposed ahead of said tape member in an inclined direction relative to said direction of advance of said copying paper, said thread member comprising means for completely separating the advancing copying paper from said photoreceptor surface.

6. A separating device as claimed in claim 5, wherein said insulating tape member is secured at both ends thereof to said electrostatic photocopying apparatus, said tape member being substantially in the form of an arc extending in said direction of advance of said copying paper.

7. A separating device as claimed in claim 5, wherein said thread member is of insulating material.

8. A separating device as claimed in claim 5, wherein said thread member is disposed at an inclined angle of from 30° to 60° relative to said direction of advance of said copying paper.

9. A separating device as claimed in claim 5, wherein said one end of said thread member is disposed at a first position, and a second end of said thread member is disposed at a second position lower than said first position and ahead of said first position relative to said direction of advance of said copying paper.

10. A separating device for use in an electrostatic photocopying apparatus of the type including a movable photoreceptor and an image transferring means, for separating copying paper from said photoreceptor, said device comprising:

an insulating tape member disposed between an image transferring means and a photoreceptor of an electrostatic photocopying apparatus;

said tape member facing one edge of a surface of said photoreceptor in a direction of advance of the copying paper;

said tape member being provided in a position allowing the transfer of an image from said photoreceptor surface to said copying paper, said insulating tape member being secured at both ends thereof to said electrostatic photocopying apparatus, said tape member being substantially in the form of an arc extending in said direction of advance of said copying paper, said tape member having surface means for guiding the leading portion of one side edge of said copying paper away from said photoreceptor surface for initial separation thereof from said photoreceptor; and a thread member of insulating material secured at one end thereof to said insulating tape member and stretchably disposed ahead of said tape member in a direction inclined to said direction of advance of said copying paper by an angle of from 30 to 60 degrees, said thread member comprising means for completely separating the advancing copying paper from said photoreceptor surface.

11. A separating device as claimed in claim 10, wherein a first end of said thread member is disposed at a first position adjacent said tape member, and a second end of said thread member is disposed at a second position lower than said first position and ahead of said first position relative to said direction of advance of said copying paper.

12. A separating device for copy paper sheets for use in a photocopying apparatus, said device comprising:

an elongate, thin separating tape of an insulating material disposed at a position between one side edge of a photoreceptor surface of a photocopying apparatus and a corresponding side edge of a copy paper sheet relative to a direction of advance of said copy paper sheet;

said tape being secured, at one portion thereof to extend lengthwise and in parallel to said direction of advance of said copy paper sheet, to said photocopying apparatus with a first surface of said tape facing said photoreceptor surface and with part of said first surface of said tape contacting said photoreceptor surface, whereby as said copy paper sheet advances the leading portion of said side edge thereof is separated from said photoreceptor surface by a second surface of said tape;

a pick-off thread forming means for further peeling said copy paper sheet off said photoreceptor surface completely;

said thread being stretched, at a discharging side for said copy paper sheet, between a first position adjacent to a first side of said photoreceptor surface on a first end of said tape adjacent said second surface thereof and a second position below a second side of said photoreceptor surface relative to a direction of movement of said photoreceptor surface; and said second position being lower than said first position and being ahead of said first position relative to said direction of advance of said copy paper sheet;

whereby said stretched thread presses a surface of said copy paper sheet downwardly as said copy paper sheet passes under said thread during advancement of said sheet.

13. A separating device for copy paper sheets as claimed in claim 2, further comprising a driving pulley, said thread passing around said driving pulley, and means for driving said driving pulley for moving said thread along said endless path.

* * * * *